US008464454B2

(12) United States Patent
Martin et al.

(10) Patent No.: US 8,464,454 B2
(45) Date of Patent: Jun. 18, 2013

(54) MODULAR ADAPTIVE GUN

(75) Inventors: James Martin, Walworth, NY (US); Scott Pilkington, Monteagle, TN (US)

(73) Assignee: Crosman Corporation, Bloomfield, NY (US)

( * ) Notice: Subject to any disclaimer, the term of this patent is extended or adjusted under 35 U.S.C. 154(b) by 338 days.

(21) Appl. No.: 13/006,998

(22) Filed: Jan. 14, 2011

(65) Prior Publication Data

US 2012/0180355 A1 Jul. 19, 2012

(51) Int. Cl.
*F41A 19/00* (2006.01)

(52) U.S. Cl.
USPC ..... 42/69.01; 42/20; 89/132; 89/139; 89/27.11; 124/70; 124/73; 124/74

(58) Field of Classification Search
USPC ..... 42/69.01, 20; 124/70, 73, 74; 89/132, 89/139, 27.11
See application file for complete search history.

(56) References Cited

U.S. PATENT DOCUMENTS 3,380,183 A 4/1968 Miller et al.
4,057,003 A 11/1977 Atchisson
4,551,936 A * 11/1985 Chauvet ..... 42/42.01
5,590,484 A 1/1997 Mooney et al.
5,712,443 A * 1/1998 Canaday et al. ..... 89/127
6,839,998 B1 1/2005 Armstrong
7,131,228 B2 11/2006 Hochstrate et al.
7,810,271 B2 10/2010 Patel
7,836,872 B2 * 11/2010 Tseng ..... 124/72
2005/0262752 A1 12/2005 Robinson et al.
2007/0033851 A1 2/2007 Hochstrate et al.
2009/0277067 A1 11/2009 Gregg

OTHER PUBLICATIONS

80% Lower Receiver Information | Tactical Machining website—dated Jan. 9, 2011 (2 pages) http://www.tacticalmachining.com/80-lower-receiver/.
Home Build FAQ website—dated Jan. 9, 2011 (7 pages) http://helboxarmory.com:Common%20Questions.htm.
80% receiver FAQ website—dated Jan. 9, 2011 (4 pages) http://www.acmearms.com/80percentfaq.php.

* cited by examiner

*Primary Examiner* — J. Woodrow Eldred
(74) *Attorney, Agent, or Firm* — Brian B. Shaw, Esq.; Harter Secrest & Emery LLP

(57) ABSTRACT

An upper receiver is provided for cooperatively engaging a lower receiver, wherein the lower receiver includes at least a trigger and a lower hammer. The upper receiver includes an upper sear movable in response to movement of the lower hammer, thereby permitting an upper hammer in the upper receiver to actuate a valve in the upper receiver and pass a motive gas to a firing chamber and thereby expel a projectile through a barrel of the upper receiver.

11 Claims, 7 Drawing Sheets

MODULAR ADAPTIVE GUN

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

1. Field of the Invention

The present system relates to a modular adaptive gun having an upper receiver assembly for cooperatively engaging a lower receiver assembly to allow the firing of a projectile from the gun.

2. Description of Related Art

Typically, a rifle includes a trigger, a hammer, and a barrel. The round is positioned in the barrel, and when the trigger is pulled, the hammer fires the round through the barrel. One type of rifle is an M16-style rifle that features a gas-operated bolt and bolt carrier system as disclosed in U.S. Pat. No. 2,951,424, issued to Eugene M. Stoner on Sep. 6, 1960, hereby expressly incorporated by reference. The M16-style rifle is the weapon used by many military and civilian police forces today.

Typically, M16-style rifles include a lower receiver that houses the trigger and hammer, and an upper receiver that houses the barrel, bolt, and bolt carrier. The lower receiver and the upper receiver are detachably coupled together using a coupling mechanism, so that the rifle can be moved with relative ease between an assembled position suited for firing, and a disassembled position suited for cleaning the rifle and for repairing its internal parts. A conventional takedown system features front and rear pins slidably positioned in the lower receiver, and corresponding front and rear connector tabs extending from the upper receiver. A distance between the pins on the lower receiver corresponds to a distance between the connector tabs on the upper receiver, so that the pins can be pushed into and out of the connector tabs to selectively attach and detach the upper and lower receivers.

In some cases, the upper receiver can be substituted with a different upper receiver, such as a close quarters battle receiver (CQBR), which is a replacement upper receiver having a relatively shorter barrel. Like the conventional upper receiver, the CQBR has connector tabs that are separated by a distance corresponding to the distance between the pins on the lower receiver, so that the CQBR can be coupled to the lower receiver. In the field, the CQBR is employed during indoor operations or other operations in which a longer barrel rifle may be cumbersome to maneuver.

Therefore, the need exists for an upper receiver that can cooperate with a variety of lower receivers, wherein the operating or performance characteristics of the upper receiver can be independent of the lower receiver. The need also exists for an upper receiver that can be configured to provide a predetermined operation for exposing a motive gas to a projectile in a firing chamber independent of the tuning or adjustment or feel of a trigger used by the operator to fire the gun.

BRIEF SUMMARY OF THE INVENTION

An upper receiver is provide for cooperatively engaging a lower receiver having a trigger and a lower hammer, the lower hammer movable between a loaded orientation and a firing orientation, wherein the upper receiver includes an upper receiver frame cooperatively engaging the lower receiver; an upper hammer movable between a cocked position and a firing position; and an upper sear movable between a release position and a retaining position, the retaining position of the upper sear retaining the hammer in the cocked position, and the upper sear in the release position permitting movement of the upper hammer to the firing position, the upper sear moving from the retaining position to the release position in response to the lower hammer moving from the loaded orientation to the firing orientation.

It is further contemplated the upper receiver can include a lockout link movable between a lockout orientation and a firing orientation, the lockout link in the lockout orientation precluding movement of the upper sear from the retaining position to the release position, and the lockout link in the firing orientation permitting movement of the upper sear from the retaining position to the release position.

In a further configuration, the upper receiver can include a carriage movable between a load position and a fire position, the carriage including a shoulder to contact the lockout link in the firing orientation of the lockout link. A carriage spring can be provided for acting on the carriage and urging the carriage to the load position.

The upper receiver can also include a charging handle connected to the upper hammer, wherein the charging handle is movable to displace the upper hammer from the firing position to the cocked position. It is also provided that the movement of the charging handle can displace the lower hammer from the firing orientation to the loaded orientation.

The upper receiver can also include a kicker connected to the upper hammer, wherein the kicker is selected to contact the lower hammer upon the upper hammer moving from the firing position to the cocked position.

The upper receiver can also include a barrel, a motive gas reservoir and a valve body fluidly, wherein the valve body is fluidly intermediate the motive gas reservoir and the barrel.

A method is also provided for engaging an upper receiver with a lower receiver to form a gun and operably interconnect a trigger and lower hammer in the lower receiver with an upper hammer and upper sear in the upper receiver, wherein movement of the trigger to a firing position results in movement of the upper hammer from a cocked position to a firing position.

A method is also provided for releasing a lower hammer in a lower receiver by moving a trigger in a lower receiver assembly from a non-firing position to a firing position; and contacting the released lower hammer with a portion of an upper receiver to release an upper sear in the upper receiver to move an upper hammer in the upper receiver from a cocked position to a firing position.

A further method includes forming an upper receiver to have an upper hammer and an upper sear, and the upper receiver being free of a trigger, the upper receiver sized to cooperatively engage a lower receiver having a trigger.

BRIEF DESCRIPTION OF THE SEVERAL VIEWS OF THE DRAWING(S)

DETAILED DESCRIPTION OF THE INVENTION

Figure 1:
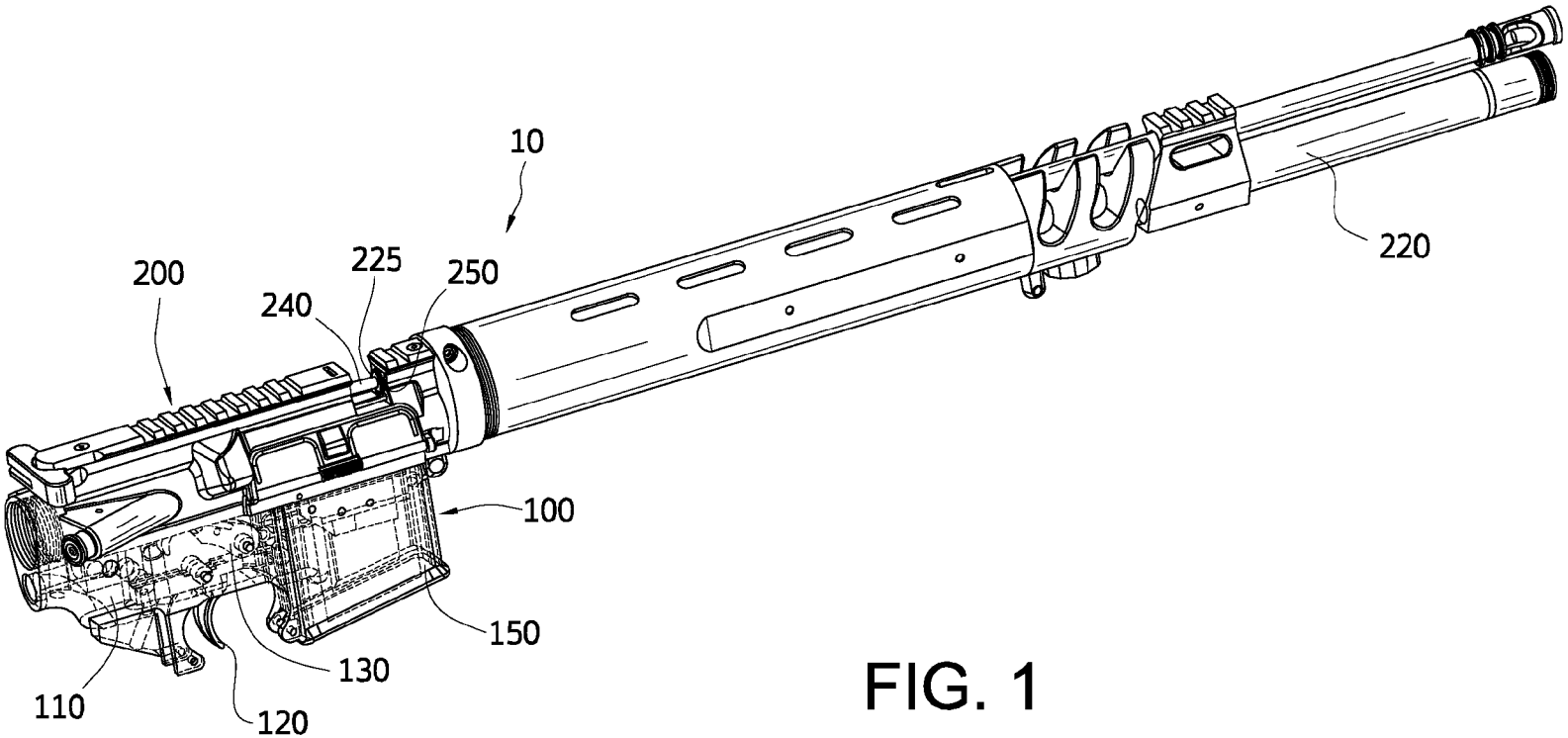
FIG. 1 is a perspective view of an upper receiver assembly and lower receiver assembly.

In FIG. 1, a gun 10 is shown. Although the gun 10 is shown in the general configuration of a rifle, it is understood the gun can take any configuration of a dischargeable device. The term "gun" is understood to encompass any device, from a small handheld weapon to a large piece of artillery that has an elongate tube or barrel through which projectiles, such as bullets or missiles are fired such as for example by an expanding motive gas. Thus, the term "gun" includes pistols, rifles or shotguns.

Although the present description as set forth in terms of a pre-charged or pre-charged pneumatic gun, it is understood that the present system can be employed with any of a variety of motive mechanisms for expelling projectiles through a barrel.

Referring to FIG. 1, the gun 10 includes a lower receiver 100, an upper receiver 200, a barrel 212, a motive gas reservoir 220, a breech 225, and a bolt 240 for disposing a projectile into a firing chamber 250.

Figure 2:
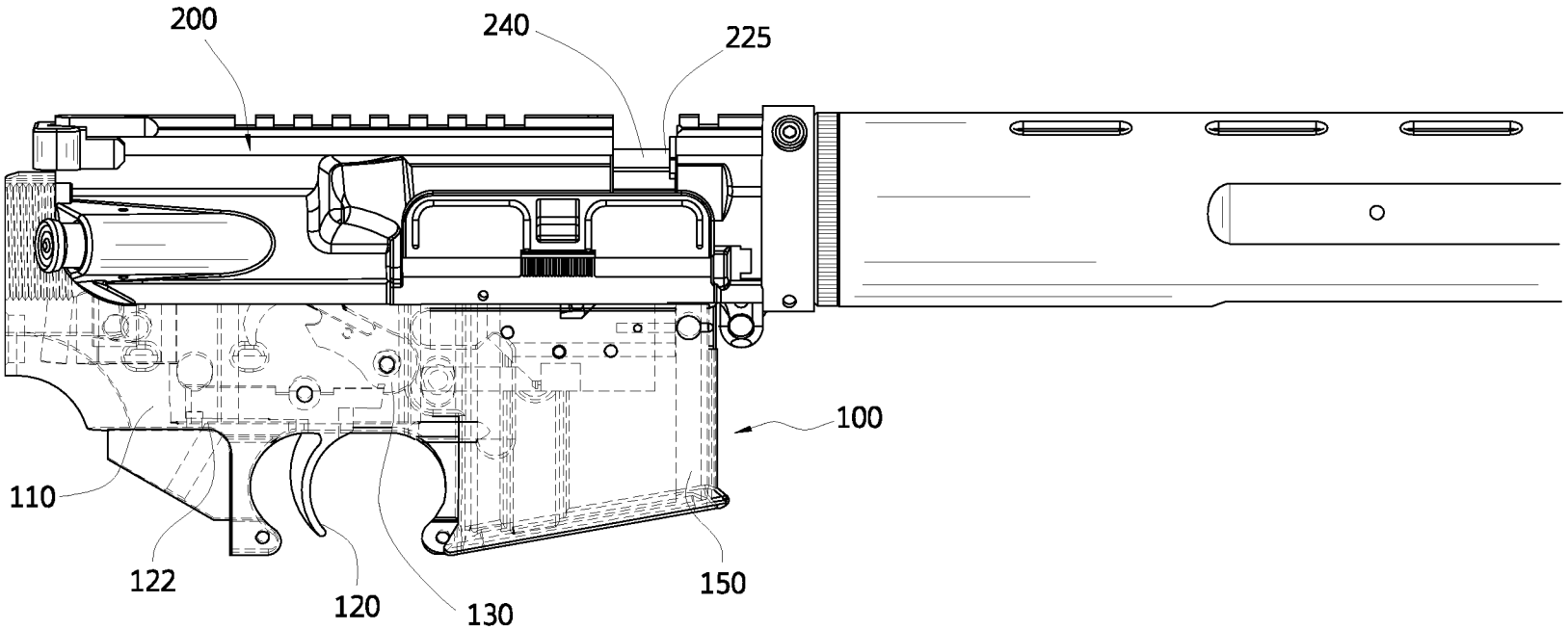
FIG. 2 is an enlarged side elevational view of the upper receiver assembly and lower receiver assembly of FIG. 1.
Figure 3:
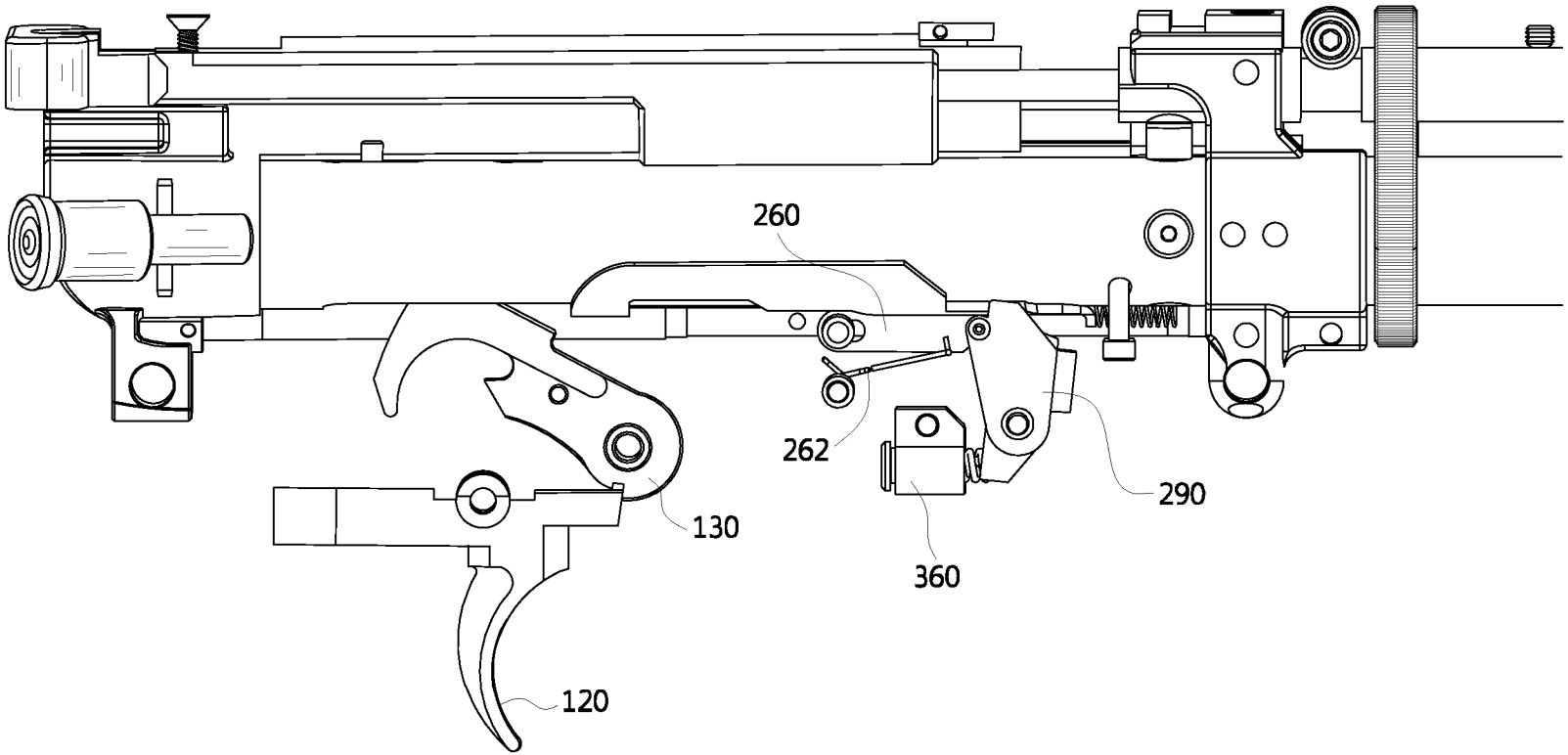
FIG. 3 is a side elevational view of selected portions of the upper receiver assembly and lower receiver assembly of FIG. 2.

Referring to FIGS. 1-3, the lower receiver 100 includes, in relevant part, a lower frame 110, a trigger 120, a lower hammer 130, and optionally a magazine well 150.

The lower frame 110 supports the trigger 120 and the lower hammer 130, and can at least partially define the magazine well 150.

The trigger 120 is movable about a pin between a firing position and a non-firing position. Although not required, a bias mechanism such as a spring 122 can be operably engaged with the trigger 120 to urge the trigger to the non-firing position.

The lower hammer 130 is pivotally movable between a loaded orientation and a firing orientation. The term "loaded" is not intended to be limited to a specific configuration with respect to the projectile, but rather merely distinguish between a position which results in a firing of the gun and a position which does not result in a firing of the gun.

A bias mechanism such as a spring 132 can be operably connected to the lower hammer to urge the lower hammer to the firing orientation. The trigger 120 and the lower hammer 130 are operably connected such that, upon disposing the trigger in the firing position, the lower hammer is moves to the firing orientation, as well known in the art.

The magazine well 150 is sized to receive a magazine or a clip (not shown). The magazine well 150 can be configured to operably engage any type of magazine or clip and does not limit the present system.

Figure 5:
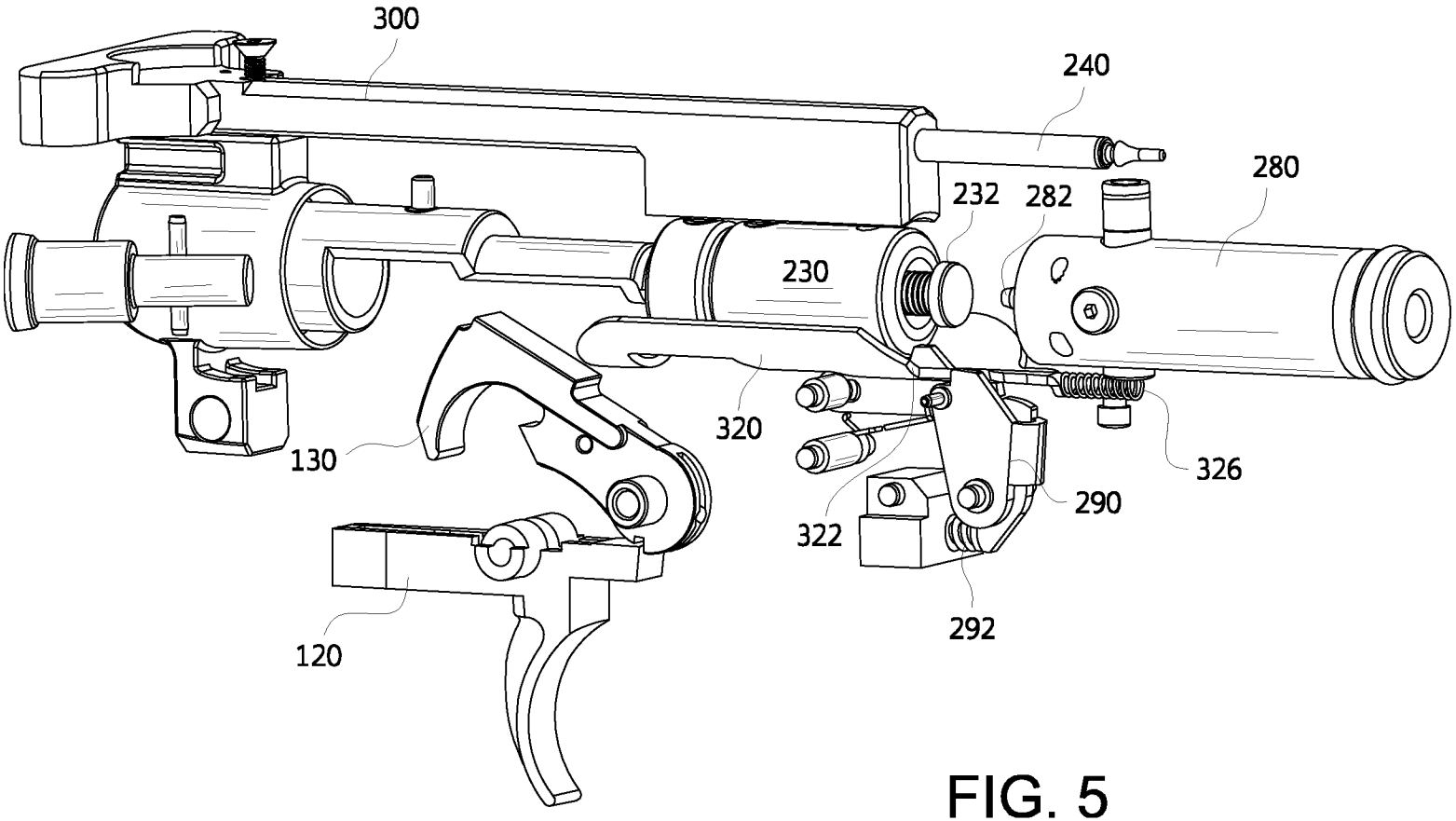
FIG. 5 is a lower right perspective view of selected portions of the upper receiver assembly and lower receiver assembly of FIG. 1.

Referring to FIG. 5, the upper receiver 200 includes an upper receiver frame 210, an upper hammer 230, an upper sear 260, a valve body 280, the motive gas reservoir 220, the barrel 12, a lockout link 290, a charging handle 300, a carriage 320, and a kicker 340.

The upper receiver frame 210 cooperatively engages the lower receiver 100 to form the gun 10. The engagement of the lower receiver 100 and the upper receiver 200 can be any of a variety of configurations, wherein the respective receivers include the necessary pins, couplings or interconnections.

The barrel 12 extends from the engaged lower and upper receivers 100, 200. The barrel 12 has a muzzle 14 through which the projectile exits the barrel and a rear end 16 at least partially defining a firing chamber 20. The firing chamber 20 houses the projectile when the projectile is exposed to the motive gas.

The valve body 280 is disposed in the upper receiver 200, and selectively communicates the motive gas reservoir 220 with the firing chamber 250. The valve body 280 is fluidly intermediate the motive gas reservoir 220 and the firing chamber 250. In one configuration, the valve body 280 includes a protruding valve stem 282.

The upper hammer 230 is movable between a cocked position and a firing position and aligns to contact the valve stem 282 or the valve body 280 in the firing position. In another configuration, the upper hammer 230 includes a projecting striker 232 for contacting the valve pin 282. In still another configuration, the striker 232 has an adjustable spacing from the upper hammer 230. That is, in one configuration the striker 232 can be a threaded member extending from the upper hammer 230. Thus, by rotating the striker 232 relative to the upper hammer 230, the striker can change the effective length of the upper hammer. An upper hammer spring 234 acts on the upper hammer 230 to bias the upper hammer toward the valve body 280. The upper hammer spring 234 can be any of a variety of springs known in the art.

Figure 6:
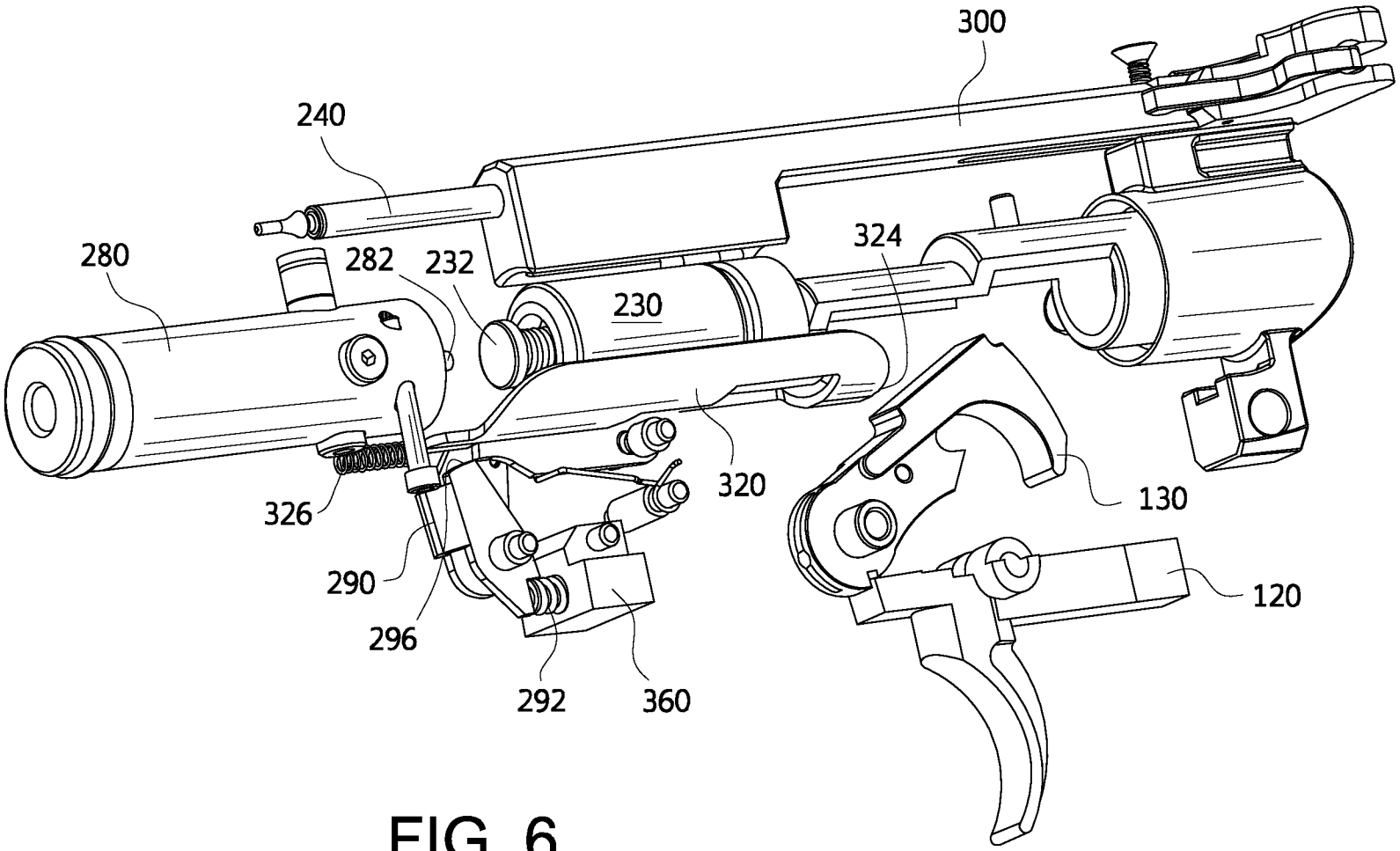
FIG. 6 is a left lower perspective view of selected portions of the upper receiver assembly and lower receiver assembly of FIG. 1.

Referring to FIG. 6, the upper sear 260 retains the upper hammer 230 in the cocked position. The upper sear 260 is movable between a released position and a retaining position, such that in the retaining position, the upper sear retains the upper hammer 230 in the cocked position. In the released position of the upper sear 260, the upper hammer 230 is allowed to move toward the valve body 280 and the valve pin 282. In the retaining position, the upper sear 260 acts against the bias of the upper hammer spring 234 and retains the upper hammer 230 in the cocked position and spaced from the valve body 280.

Referring to FIGS. 5 and 6, the upper sear 260 is biased to the retaining position by an upper sear spring 262. The upper sear spring 262 can be any variety of bias mechanisms including torsion spring, coil spring, as well as gas spring or leaf spring or any equivalent bias mechanism.

Referring to FIGS. 5 and 6, the lockout link 290 is selectively rotatably engageable with the upper sear 260. The lockout link 290 is movable between a lockout orientation and a firing orientation. A bias mechanism 292 engages the lockout link 290 to urge the lockout link to the lockout orientation. The bias mechanism 292 can be any of a variety of mechanisms known in the art, including torsion spring, coil spring, as well as gas spring or leaf spring or any equivalent bias mechanism.

The lockout link 290 in the lockout orientation precludes movement of the upper sear 260 from the retaining position to the release position. That is, the lockout link 290 supports the upper sear 260 to remain in contact with the upper hammer 230, retaining the upper hammer in the cocked position.

The lockout link 290 in the firing orientation permits movement of the upper sear 260 from the retaining position to the released position, thereby permitting movement of the upper hammer 230 from the cocked position to the firing position. That is, in the firing position of the lockout link 290, the lockout link does not support the upper sear 260.

The lockout link 290 is rotatable about a main pivot 294 between the lockout orientation and the firing orientation. The lockout link 290 includes a contact face 296 and an interference face 298. The interference face 298 contacts the upper sear 260 upon the lockout link assuming the lockout orientation.

The contact face 296 is selected to be contacted in response to the lower hammer 130 moving from the loaded orientation to the firing orientation. In selected configurations, the lockout link 290 can be directly contacted by the lower hammer 130. In further configurations, an intermediate coupler can be operably disposed between the lower hammer 130 and the upper sear 260.

Figure 4:
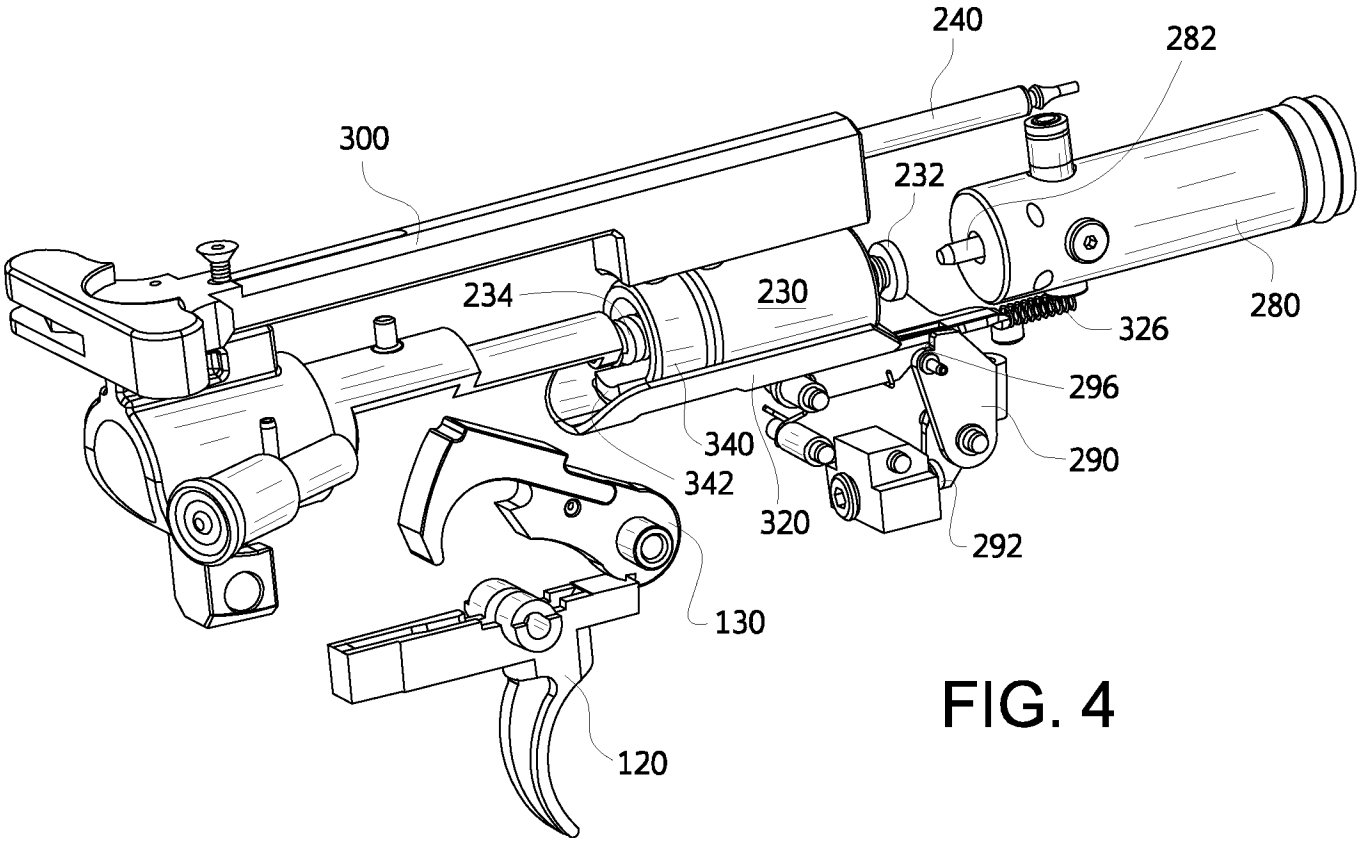
FIG. 4 is an upper perspective view of selected portions of the upper receiver assembly and lower receiver assembly of FIG. 2.

In further configurations, the upper receiver 200 can be configured such that the lower hammer 130 acts directly upon the upper sear 260 or the lockout link 290. In another configuration, a carriage 320 is employed to mechanically couple the lower hammer 130 and the lockout link 290 (and hence the upper sear 260). As seen in FIGS. 4, 5, and 6, the carriage 320 is movable between a cocked position and a firing position. The carriage 320 includes a shoulder 322 sized to engage the contact face 296 of the lockout link 290 upon the lockout link being disposed in the firing orientation. The carriage 326 also includes a rear end 324 configured to contact the lower hammer upon the lower hammer 130 moving to the firing orientation. A carriage return spring 326 acts upon the carriage 320 urging the carriage to the load position.

Figure 7:
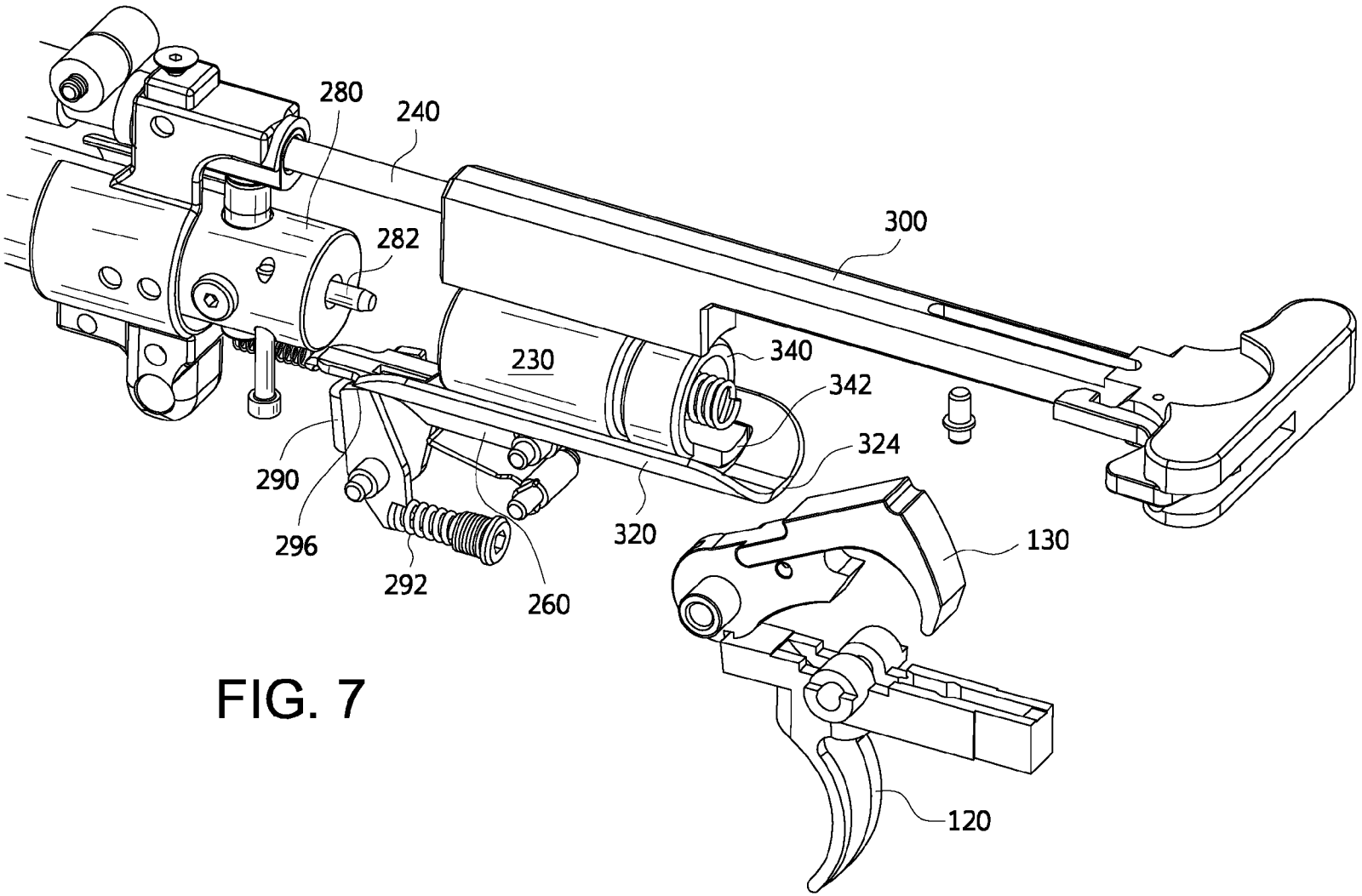
FIG. 7 is an upper left perspective view of selected portions of the upper receiver assembly and lower receiver assembly of FIG. 1.

Referring to FIGS. 4, 5, and 7, a kicker 340 can be operably connected for movement with the upper hammer 230, wherein the kicker includes a contacting surface 342 for engaging the lower hammer 130 such that upon movement of the kicker, the lower hammer returns to the loaded orientation.

In one configuration, the lockout link 290 is operably connected to a magazine contact 360 which interfaces with the magazine well 150 of the lower receiver 100 and, upon the presence of a magazine in the magazine well, the lockout link 290 is moved to the firing orientation. The absence of a magazine in the magazine well 150 of the lower receiver 100 allows the bias on the lockout link 290 to rotate the lockout link to the lockout orientation thus precluding movement of the upper sear 260 to the release position.

Further, referring to FIGS. 4-7, the charging handle 300 is operably connected to the upper hammer 230 and the kicker 340, wherein the upper handle is selectively movable between a rest position and a re-cocking position. Although the charging handle is shown as a pull back handle, it is understood a side handle, bolt handle or other handle can cooperatively engage the upper hammer 230.

In operation, the bolt 240 is moved to dispose a projectile in the firing chamber 250 of the upper receiver 200. The trigger 120 is actuated in the lower receiver 100 as well known in the art. Actuation of the trigger 120 releases the lower hammer 130 from a loaded orientation to the firing orientation. Movement of the lower hammer 130 to the firing orientation strikes the rear end 324 of the carriage and causes the carriage 320 to move forward against the bias of the carriage return spring 326.

Upon the lockout link 290 being disposed in the firing orientation, the shoulder 322 of the carriage 320 moving forward contacts the contact face 296 of the lockout link causing the lockout link to move from the lockout orientation to the firing orientation. In the firing orientation, the lockout link 290 no longer supports the upper sear 260. The upper hammer spring 234 acting upon the upper hammer 230 urges the upper hammer from the cocked position to the firing position and the striker 232 contacts the valve stem 282 of the valve body 280, and the valve body passes motive gas from the motive gas reservoir 220 to the firing chamber 20 and thus propels the projectile through the barrel 212.

Alternatively, if the magazine contact 360 is not moved due to presence of a magazine in the magazine well 150, the lockout link 290 is rotated to the lockout orientation thereby continuing support of the upper sear 260. In addition, rotation of the lockout link 290 to the lockout orientation moves the contact face 296 of the lockout link from the travel path of the shoulder 322 of the carriage 320. Thus, upon moving the trigger 120 and lower hammer 130, and the lower hammer engaging the carriage 320 causing forward movement of the carriage against the carriage return spring 326, the shoulder 322 of the carriage does not engage the lockout link 290 and the upper hammer 230 remains retained by the upper sear 260 and thus the gun 10 is not fired.

The charging handle 300 is moved from the firing position to the cocked position thus rearwardly translating the upper hammer 230 and the kicker 340 such that the upper hammer moves rearward of the upper sear 260 and the bias mechanism 262 on the upper sear allows the upper sear to rotate from the release position to the retaining position. This motion of the charging handle 300 also causes the kicker 340 to engage the lower hammer 130 to return the lower hammer from the firing orientation to the loaded orientation.

As the actuation of the upper hammer 230 on the valve body 280 is independent of the trigger pressure necessary to actuate the trigger 120 and the lower hammer 130, the present system provides for customization of the trigger action and pressure in the lower receiver 100, without adversely affecting the firing characteristics of the upper hammer 230 and the valve body 280. Conversely, the firing characteristics of the upper hammer 230 and valve body 280 can be configured, such as by relative position of the striker 232 relative to the upper hammer 230; sizing of the upper hammer spring 234; and sizing of the upper sear spring 262 such as performance characteristics of the upper receiver 200 are independent of the trigger characteristics of the lower receiver 100.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. An upper receiver for cooperatively engaging a lower receiver having a trigger and a lower hammer, the lower hammer movable between a loaded orientation and a firing orientation, the upper receiver comprising:

(a) an upper hammer movable between a cocked position and a firing position; and (b) an upper sear movable between a release position and a retaining position, the retaining position of the upper sear retaining the hammer in the cocked position, and the upper sear in the release position permitting movement of the upper hammer to the firing position, the upper sear moving from the retaining position to the release position in response to the lower hammer moving from the loaded orientation to the firing orientation.

2. The upper receiver of claim 1, further comprising a lockout link movable between a lockout orientation and a firing orientation, the lockout link in the lockout orientation precluding movement of the upper sear to the release position, and the lockout link in the firing orientation permitting movement of the upper sear to the release position.

3. The upper receiver of claim 2, further comprising a carriage movable between a load position and a fire position, the carriage including a shoulder to contact the lockout link in the firing orientation of the lockout link.

4. The upper receiver of claim 3, further comprising a carriage spring acting on the carriage and urging the carriage to the load position.

5. The upper receiver of claim 1, further comprising a charging handle connected to the upper hammer, the charging handle movable to displace the upper hammer from the firing position to the cocked position.

6. The upper receiver of claim 5, wherein the movement of the charging handle displaces the lower hammer from the firing orientation to the loaded orientation.

7. The upper receiver of claim 1, further comprising a kicker connected to the upper hammer, the kicker selected to contact the lower hammer upon the upper hammer moving from the firing position to the cocked position.

8. The upper receiver of claim 1, further comprising a barrel.

9. The upper receiver of claim 8, further comprising a motive gas reservoir and a valve body, the valve body fluidly intermediate the motive gas reservoir and the barrel.

10. A method comprising:

(a) engaging an upper receiver with a lower receiver to form a gun and operably interconnect a trigger and lower hammer in the lower receiver with an upper hammer and upper sear in the upper receiver, wherein movement of the trigger to a firing position results in movement of the upper hammer from a cocked position to a firing position.

11. A method comprising:

(a) releasing a lower hammer in a lower receiver by moving a trigger in the lower receiver from a non-firing position to a firing position; and (b) contacting the released lower hammer with a portion of an upper receiver to release an upper sear in the upper receiver to move an upper hammer in the upper receiver from a cocked position to a firing position.

* * * * *